United States Patent [19]

Aoyama et al.

[11] Patent Number: 4,528,152

[45] Date of Patent: Jul. 9, 1985

[54] METHOD FOR OBTAINING DRAIN-CAST HOLLOW ARTICLES FOR CERAMIC WARE

[75] Inventors: Fumihiko Aoyama; Kazushige Murata, both of Tokoname; Masahiro Hayashi, Nagoya, all of Japan

[73] Assignee: Inax Corporation, Tokoname, Japan

[21] Appl. No.: 494,099

[22] Filed: May 12, 1983

[30] Foreign Application Priority Data

May 27, 1982 [JP] Japan ..... 57-91086

[51] Int. Cl.[3] ..... B28B 1/26

[52] U.S. Cl. ..... 264/87; 264/571; 264/101

[58] Field of Search ..... 264/86, 87, 101, 571

[56] References Cited

U.S. PATENT DOCUMENTS

| | | | |
|---|---|---|---|
| 3,288,424 | 11/1966 | Dean | 264/86 |
| 3,536,799 | 10/1970 | Spy | 264/86 |
| 3,663,681 | 5/1972 | Ehrlich | 264/86 |
| 3,812,229 | 5/1974 | Anderson | 264/86 |
| 4,413,966 | 11/1983 | Mills | 264/86 |

*Primary Examiner*—Jan Silbaugh

*Attorney, Agent, or Firm*—Browdy and Neimark

[57] ABSTRACT

An apparatus for drain-casting a slip comprises a mold including at least two divisible mating mold portions to form a mold cavity, a slip tank, a pump, air compressors, suction pumps, valves and tubings to connect them accordingly, supporting means of the mold portions, and a moving stand to receive the molded article thereon. The mold portion includes an air-tight vessel and a filter member inside the vessel, the filter member contains a water-drainage means, and the drainage means is communicated with the outside of the vessel. One of the mold portions has a slip supply duct and one other mold portion has an overflow duct, which ducts are communicated with the outsides of the vessels. A method using such apparatus to form hollow ceramic or porcelain ware comprises pressurizing a slip introduced into the mold cavity and preferably depressurizing the water-drainage means to deposit the slip onto the filter members, draining an undeposited slip through the slip supply duct, removing one of the mold portions by applying compressed air to the water-drainage means of the mold portion to exude some water between the filter member and the resulting molded article, depressurizing the water-drainage means of the other mold portion to attract the molded article into the mold portion, hanging the molded article attracted into the mold portion, applying compressed air to the water-drainage means as described above, and thus demolding the molded article on the stand safely.

17 Claims, 4 Drawing Figures

METHOD FOR OBTAINING DRAIN-CAST HOLLOW ARTICLES FOR CERAMIC WARE

BACKGROUND OF THE INVENTION

This invention relates to a method for obtaining drain-cast hollow articles and an apparatus therefor. More particularly, this invention relates to a method for drain-casting a slip and an apparatus therefor to obtain substantially hollow molded articles which are then burned to produce substantially hollow ceramic or porcelain ware such as sanitary ware, art ware, other ceramic ware vessels or tanks, and the like.

Conventional methods for drain-casting slips comprise, for example, filling the mold cavity of a divisible gypsum mold which has been dried with a slip, depositing the slip onto the surface of the gypsum mold by the action of gypsum in absorbing water from the slip, draining undeposited slip remaining in the mold by gravity, increasing the strength of the resulting molded article by having the moisture of the deposited slip absorbed into the gypsum mold, and then removing the mold by hand operations to obtain the molded article. Such conventional methods, however, produce only two or less molded articles in 8 hours due to the limited water-absorption capacity of a dried gypsum mold, and the used gypsum mold which has absorbed water needs drying for 6 to 18 hours before it can be reused. Moreover, the production capacity per working period is very low and also the use-life of such gypsum molds is short (about 80 cycles) due to the deterioration which occurs in prolonged drying. Thus, the production cost of such molded articles becomes high. As one of the approaches to shorten the time required for drying the mold, there is disclosed, in U.S. Pat. No. 3,156,751, a water-absorbing mold for casting a slip wherein a porous conduit such as cotton rope is embedded and the conduit is communicated with a duct outside of the mold. In this case, compressed air is applied to the porous conduits through the duct to drive absorbed water out of the used mold for drying. As far as is known, however, such a mold is not practical because of troublesome hand operations for fabricating and/or drying the mold.

On the other hand, a method for cast-molding a slip to produce a solid (not hollow) molded article is disclosed in U.S. Pat. No. 3,243,860, wherein a mold including at least two mold portions supported by perforate steel back-up members is repeatedly used. The apparatus to be used to conduct the solid-casting method comprises a mold including at least two mating mold sections each including a perforate steel back-up member and defining a shape for the article to be molded. U.S. Pat. No. 3,243,860 is absolutely silent as to the step of draining an undeposited slip, and it is actually impossible to drain the undeposited slip from the disclosed apparatus. More specifically, with reference to FIG. 1 of the U.S. patent, the mold cavity of the mold 10 can be filled with a pressurized slip since the air present in the mold cavity is purged through the joint surfaces between the mold sections 12 and 14, although the mold sections are clamped together. The gaps between the joint surfaces are then clogged by deposition of the slip thereon. Thus, it is actually impossible to drain an undeposited slip from the mold cavity owing to a vacuum action, because the gaps are clogged and air can not pass through the gaps. In the process of the U.S. patent, the pressurization effect of the slip is lowered to 1/5 or less toward the end of the process because only the slip in the core region of the molded article is present in the state of highly viscous liquid, and thus it takes a longer time to cast-mold the article. Even after removing the mold, it is thus impossible to drain the viscous slip from the molded article. Moreover, according to that patent, it is very difficult to take the article thus molded out of the mold without damage or deformation. It is necessary to stand the molded article in the mold for 30 minutes or more before demolding to harden the molded article, and even so about 50% of the molded articles will be damaged when a large-size article such as sanitary ware is demolded.

In this connection, it is noted that the patent states that "mold times of substantially less than five minutes are found to be possible" (Col. 4, lines 51 and 52 of the U.S. Pat. No. 3,243,860). This passage, however, is understood by those skilled in the art to mean that the cast-molding itself of small-size solid articles such as dishes may be conducted by dehydration of a slip in a mold in 5 minutes or less, but the article is demolded by hand operations after hardening it in the mold for a considerably longer period of time. Thus, the method and apparatus of the U.S. Patent can not be used successfully for obtaining a large-size or heavy molded article such as sanitary ware efficiently, especially because of the difficulty in removing the mold.

SUMMARY OF THE INVENTION

The present inventors have conducted intensive research on drain-casting a slip efficiently by using a mold repeatedly. The present inventors have solved the above mentioned problems by utilizing a mold including at least two divisible mating mold portions, each mold portion including a pressure-proof air-tight vessel and a filter member inside the vessel, said filter member having therein a water-drainage line or conduit which is more porous than the filter material, said conduit being communicated with the openings outside of the vessel. Thus, the step of casting a slip is effectively conducted by pressurizing the slip and draining water through the water conduit, preferably by depressurizing the conduit. Then, the freshly cast-molded article is held against one of the mold portions by vacuum by depressurizing the water conduit, the other mold portion is removed, and a stand is moved beneath the hanging article onto which such article is released to rest thereon without deformation or damage.

Incidentally, it should be noted that a large or medium-size molded article such as sanitary ware is generally required or preferred to be a hollow (not solid) article in order to decrease its molding time and its weight as well as the heat energy in the subsequent burning step, but such a hollow article freshly molded is very weak and apt to undergo deformation or damage especially when the molded article is taken out of the mold. It should be further noted that such hollow molded articles are indispensable for producing ceramic ware tanks or hollow vessels, which can be efficiently obtained according to the present invention.

It is an object of the present invention to provide a method for drain-casting a slip effectively and efficiently by using a mold repeatedly to obtain a substantially hollow molded article for ceramic or porcelain ware.

It is another object of the present invention to minimize the time required for molding the article and for removing the molded article from the mold without deformation or damage.

It is a further object of the present invention to provide an apparatus for accomplishing the above objectives.

Other objects, features and advantages of the present invention will be apparent from the following description and drawings.

Incidentally, the term "drain-casting" used herein refers to the operation of cast-molding a slip into a hollow article by draining the undeposited slip remaining in a mold cavity. The term "substantially hollow molded article" used herein means both a molded article composed essentially of hollow parts and a molded article composed of major hollow parts and minor solid parts such as a built-in washbowl.

In accordance with the present invention, there is provided a method for drain-casting a slip to obtain a substantially hollow molded article for ceramic or porcelain ware products, by the use of an apparatus comprising a mold including at least two divisible mating mold portions to form a mold cavity, each mold portion including a pressure-proof air-tight vessel and a filter member inside the vessel, said filter member containing a means for draining water contained in the slip such as a water-drainage conduit placed at suitable intervals, said water-drainage means such as conduits being communicated with the openings outside of the vessel, one of said mold portions having an overflow duct communicated with the outside of the vessel, and one other mold portion having a slip supply duct; which method comprises the steps of:

supplying a slip through the slip supply duct to the mold cavity of the apparatus until the supplied slip overflows the overflow duct;

closing the slip supply duct and pressurizing the slip to facilitate deposition of the slip onto the filter members of the mold to a desired thickness while draining water away from the mold;

adjusting the position of the slip supply duct downward and draining the undeposited slip remaining in the mold cavity through the slip supply duct;

depressurizing the water-drainage means of one mold portion, applying compressed air to the water-drainage means of the other mold portion to exude some water between the filter member and the resulting molded article, and removing the latter mold portion; and then hanging the molded article attracted into the former mold portion, providing a stand beneath the molded article, and applying compressed air to the water-drainage means of the mold portion to exude some water between the filter member and the molded article whereby demolding of the molded article on the stand occurs safely without deformation or damage of the molded article.

There is also provided an apparatus for drain-casting a slip to obtain a molded article for ceramic or porcelain ware products which comprises:

a mold including at least two divisible mating mold portions which form a mold cavity (e.g., a mold consisting essentially of an upper mold portions and a lower mold portion), each mold portion including a pressure-proof air-tight vessel and a filter member inside the vessel, the inner surfaces of said filter members of the mold portions defining the shape of the article to be molded, said filter member containing a water-drainage means such as a conduit placed at suitable intervals, said water-drainage means being communicated with the openings outside of the vessel, and one of said mold portions having a slip supply duct and one other mold portion having an overflow duct, both ducts being communicated with the outsides of the vessels;

a slip tank, valves and a pump connected through tubing with the slip supply duct of the mold portion;

an air compressor connected via a multi-way valve and an overflow tank with the overflow duct of the mold portion;

an air compressor and a suction pump connected via multi-way valves through tubing with the openings of each water-drainage means such as a conduit in the filter members, respectively;

means for supporting each of the mold portions, at least one of the mold portions being supported movably from the mating position thereof to the waiting position thereof; and a moving stand to receive a molded article thereon safely.

DETAILED DESCRIPTION OF THE INVENTION

Figure 1:
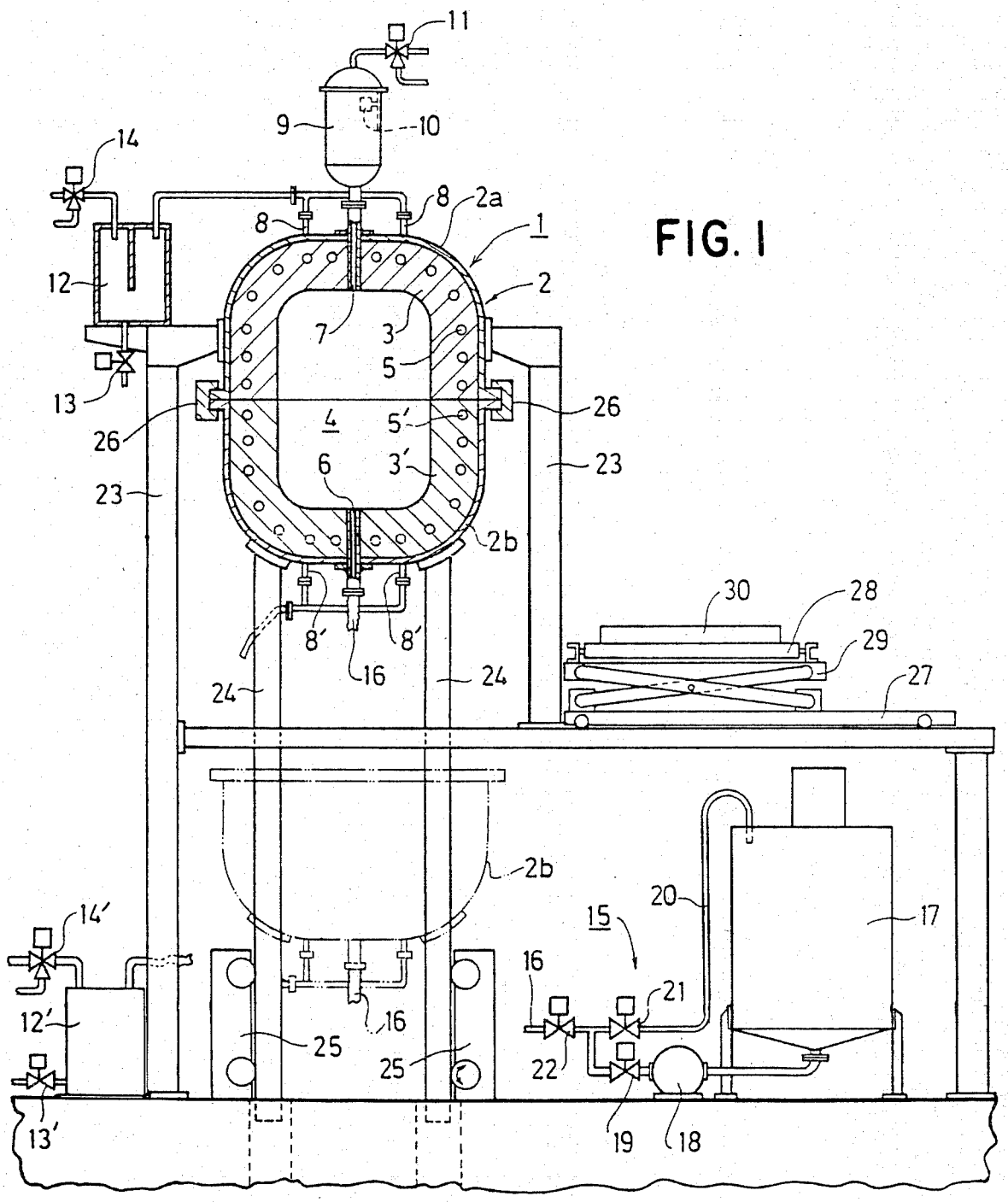
FIG. 1 is a partially sectional schematic elevational view showing an embodiment of the apparatus for drain-casting a slip to obtain a hollow molded article in accordance with the present invention.

The present invention will be further explained in detail with reference to the drawings attached hereto. It is to be noted, however, that one of the mold portions having an overflow duct is shown as an upper mold portion and the other mold portion having a slip supply duct is shown as a lower mold portion in the drawings. But, these mold portions may be arranged in other fashions (e.g., horizontally) as necessary, provided that the mold portion having the slip supply duct is designed to be in a gravitationally lowered position when the slip remaining in the mold cavity is drained and also provided that one of the mold portions is designed to attract and hold a molded article when the article is demolded onto a stand.

FIG. 1 is a partially sectional schematic view showing an embodiment of the apparatus for drain-casting a slip according to the present invention. In FIG. 1, a mold 1 includes at least two divisible mating mold portions consisting essentially of an upper mold portion 2*a* and a lower mold portion 2*b* to form a mold cavity 4. Each of the mold portions includes a pressure-proof air-tight vessel 2 and a filter member 3, 3' inside the vessel 2. The inner surfaces of the filter members define a shape of the article to be molded when the mold portions are mated together. Each of the filter members has therein a water-drainage means such as a water-drainage conduit 5, 5' placed at suitable intervals. The water-drainage means (hereinafter referred to as a conduit or conduits) is communicated with the openings outside of the vessel 2. The upper mold portion 2*a* has a overflow duct 7 at its top and the lower mold portion 2*b* has a slip supply duct 6 at its bottom, the ducts of which are communicated with the mold cavity 4 and with the openings outside of the vessels 2. The upper mold portion is fixed to supporting bars 23. The lower mold portion is supported by moving bars 24 and is movable from a mating position of these mold portions to a lower waiting position shown by two-dotted chain lines in FIG. 1. The moving bars 24 are driven by elevator means 25. When the upper and lower mold portions 2*a*, 2*b* are mated together, they are firmly fixed by clamps 26 at their outer flanges. The mold 1 is normally composed of two mold portions as shown in the drawings, but either or both of the mold portions can be designed to be further divided into a plurality of mold parts in accordance with the shapes and structures of the article to be molded.

The mold 1 is pipe-lined in the following way. An overflow tank 9 is connected with the overflow duct 7, has therein a liquid-level detector 10, and is also connected with a three-way valve 11 at its upper position. One end of the valve 11 is opened to atmosphere and other end thereof is connected with an air-compressor (not shown in the drawing). The outer tubing 8 or 8′ communicated with the water-drainage conduit 5 or 5′ is connected with a gas-liquid separator 12 or 12′. The separator 12 or 12′ is equipped with a draining valve 13 or 13′ and a three-way valve 14 or 14′. One end of three-way valve 14 or 14′ is connected with an air-compressor (not shown) and the other end thereof is connected with a suction pump (not shown).

The slip supply duct 6 is connected through a flexible tube 16 with a valve 22 of a slip supply unit 15. The unit 15 comprises a slip tank 17, a pump 18 the entrance of which is connected with the bottom of the tank 17, a valve 19 connected with the exit of the pump 18 and with valves 22 and 21, and a slip-returning tube 20 connected via the valve 21 with the valve 22. The slip supply unit 15 is installed at a position lower than the mold 1 to utilize the gravity drop of the slip as shown in FIG. 1. The unit 15, however, may be set at a position higher than the mold 1 by the use of a slip-draining pump (not shown). A wagon 27 to carry a molded article 31 (FIG. 2) is equipped in a preferred embodiment. The wagon 27 includes a table filter 29 and a conveyor 28 set thereon. The table filter 29 is movable from a waiting position (shown by two-dotted chain lines in FIG. 3) to an article-receiving position (shown by full lines in FIG. 3). A pallet 30 to receive the molded article 31 is placed on the conveyor 28.

Incidentally, the apparatus for drain-casting a slip shown in FIG. 1 comprises an upper mold portion 2*a* fixed at an upper position and a lower mold portion 2*b* supported movably at a position under the upper mold portion 2*a*, but the condition for supporting the mold portions is not always restricted to such an embodiment. For example, a lower mold portion having a slip supply duct may be supported by supporting bars in a fashion to rotate upside down, and a mold portion having an overflow duct may be supported at the upper position of the other mold portion in a fashion movable up and down, although not shown by the drawings. In such an embodiment, the upper mold portion is removed first, the lower mold portion having a slip supply duct is turned upside down, and then the mold article is demolded onto a stand. This embodiment is especially useful in the case where a molded article having a substantially protuberant part is produced by designing the mold to contain the protuberant part in the lower mold portion, wherein the upper portion is removed first and then the lower mold portion is turned upside down with the molded article hanging therefrom for demolding, so that the undeposited slip can be readily drained and the molded article can be demolded safely onto a stand.

The above mentioned filter members 3, 3′ consist essentially of porous filter materials having a suitable co-hesive or self-binding property which can withstand the pressure to be applied to the filter members 3, 3′. The porous materials for the filter members include, for example, gypsum, porous cement materials, porous plastics, porous metal, porous ceramics, and mixtures thereof, which are known as such filter materials in the art. From the viewpoint of efficiently fabricating a mold including the filter members, the porous materials for the filter may be preferably of a material dispersible in water or liquid. The above-mentioned water-drainage means such as conduits 5, 5′ are preferably composed of a permeable conduit such as tubes or cords which are more porous than the filter materials. Such permeable materials are not especially restricted as long as they are more permeable and porous than the filter materials. For example, a knitted filter (e.g., cotton) tube having an outer diameter of about 2 mm to about 20 mm can be effectively used as a typical material therefor.

The filter members 3, 3′ having therein the water-drainage conduits 5, 5′ can be fabricated effectively in the following manner. First a model having dimensions larger by the distance between the inner surfaces of the filter members 3, 3′ and the water-drainage conduits 5, 5′ than those of the article to be molded is manufactured (e.g., by 40 mm to 100 mm). A screen wire is then pressed against the surface of the model to obtain a pressed screen wire cage such as the cage 32 in FIG. 4, having a form similar to the shape of the filter members 3, 3′ to be made. One or a plurality of porous tubes for forming the water-drainage conduit are fixed on the resulting pressed screen wire cage 32 at a suitable interval between the adjacent tubes, e.g. at a distance of 5 to 100 mm, for example by winding the tubes around the screen wire.

The pressed wire cages having the porous tubes fixed (cf. 33, FIG. 4) are accommodated inside the pressure-proof vessels for the upper mold portion 2*a* and the lower mold portion 2*b*, respectively. The ends of the porous tubes are inserted in the openings 8, 8′ outside of the pressure-proof vessels 2, respectively. Then, the corresponding part of the prototype model for the article to be molded is placed in the lower mold portion 2*b* composed of the pressed wire cage 33 and the pressure-proof vessel, the distance between the prototype model and the pressed screen wire cage defining an effective thickness of the filter member. A slurry of the above-mentioned filter material is poured into the space between the prototype model and the vessel for the lower mold portion 2*b*, and then is hardened to form the lower mold portion. After hardening the poured filter material, the vessel containing the pressed wire cage 33 for the upper mold portion 2*a* is mated with the lower mold portion 2*b*. The liquified filter material (i.e. the slurry) is then poured into the space between the upper part of the prototype model and the vessel for the upper mold portion 2*a* and is hardened.

Finally, the pressure-proof vessel 2 is divided into two portions and the prototype model for the article to be molded is removed. Thus, there is successfully provided a mold including two divisible mating mold portions, each mold portion of which comprises a pressure-proof vessel, a filter member inside the vessel, and a water-drainage conduit placed at suitable intervals and embedded in the filter member, the conduit being communicated with the openings outside of the vessel.

Figure 4:
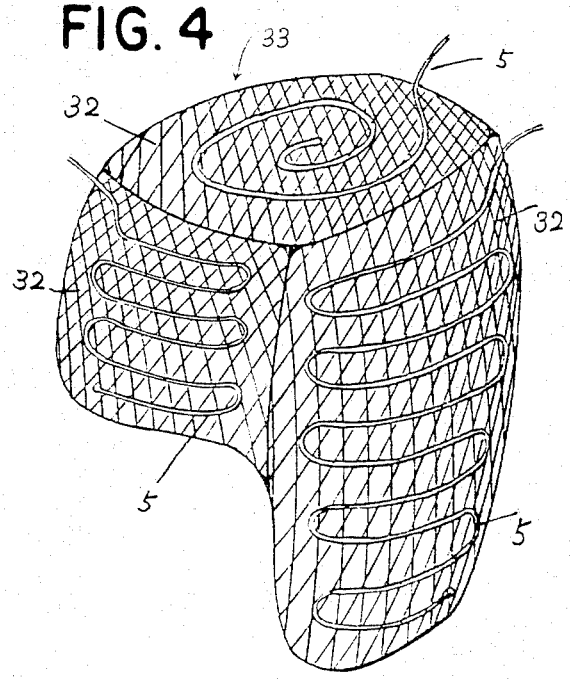
FIG. 4 is a schematic perspective view showing a pressed screen wire cage having porous tubes fixed thereon for a water-drainage conduit to be contained in a filter member, in accordance with a preferred embodiment of the present invention.

Incidentally, as to the arrangement of the porous tubes or the like for forming the water-drainage conduit, it is preferred that one continuous circuit tube or the like cover only one or two main surfaces of the pressed screen wire cage 32 and one or both ends of each tube be communicated with the openings outside of the vessel independently as schematically shown in FIG. 4, in order to conduct drainage of water, pressurization to exude water and depressurization to attract the molded article into the mold portion effectively and also to provide for the local breakage of the filter member. In other words, it is preferred that the water-drainage conduit contained in the filter member be divided into a plurality of circuits, e.g. four or five circuits in the case of FIG. 4, composed of porous tubes or the like, and each of the circuits be independently communicated with the openings outside of the pressure-proof vessel.

The preferred embodiments of the apparatus and especially of the filter members are given below. These data, however, can be readily modified by those skilled in the art on the basis of the present disclosure in accordance with the filter material to be used, the slip to be used and other relevant factors.

(a) Effective thickness of the filter member

The effective thickness refers to a distance between the inner surface of the filter member and the water-drainage conduit. The thickness required depends on filtering characteristics and mechanical strength of the filter member. A porous sheet 1 mm or less thick having good mechanical strength may also be used. In the case of a fragile filter material such as gypsum, the thickness is determined in view of mechanical strength and is in the range of 1- to 8-fold thickness of the diameter of the water-drainage conduit, and preferably in the range of about 2- to about 5-fold thickness thereof. For example, a thickness of about 20 mm is used in the case of a knitted cotton tube conduit 10 mm in diameter. When the effective thickness is over 100 mm, it will sometimes become difficult to remove a molded article from the mold smoothly.

(b) Porosity of the filter material

This also depends on the mechanical strength of the filter material and is generally in the range of 10% to 80%. In the case of gypsum, the porosity is preferably in the range of 30% to 60% and typically about 40% to about 45%.

(c) Pore size of the filter material

This may depend on the slip and pressure to be employed, and is generally in the range of 1 to 60 microns. In the case of gypsum, the pore size is preferably 1 to 40 microns and typically 1 to 30 microns.

(d) Permeability variation of the filter member

The permeability of the filter member should be substantially uniform in principle, but a variation thereof up to about 15% is empirically allowable.

(e) Interval or distance between the water-drainage conduits

This depends upon the characteristics of the intended slip, the porous material for the conduit as well as the shape and size of the article to be molded. In the case of a knitted cotton tube 10 mm in its outer diameter, the interval between the conduits is in the range of 0 to 100 mm, preferably 5 to 6 mm and typically 10 to 50 mm.

The method for drain-casting a slip according to the present invention can be carried out in the following way by using the apparatus shown in FIG. 1.

A slip pressurized by the pump 18 is supplied via the valve 19, valve 22, flexible tube 16 and slip supply duct 6 into the mold cavity 4 formed by mating the upper mold portion 2*a* and the lower mold portion 2*b* together. The valve 11 is opened to atmosphere in the course of supplying the slip. When the slip supplied reaches the overflow tank 9 via the overflow duct 7, apparent from the indication of the liquid level detector 10, the pump 18 is stopped and the valve 22 is closed. Compressed air, e.g. about 5 to 15 kg/cm$^2$, is then supplied into the overflow tank 9 by turning the valve 11 to pressurize the slip within the mold cavity 4. At the same time, the pressure within the gas-liquid separators 12, 12' is made atmospheric pressure by opening the valves 13, 13', or alternatively, is made negative pressure, e.g. about 300 to 700 mmHg, by closing the valves 13, 13' and turning the valves 14, 14'. Thus, the pressurized slip within the mold cavity 4 is rapidly deposited onto the surfaces of the filter members 3, 3' because water contained in the slip is expressed through the filter members into the drainage conduits 5, 5' having lower pressure. After the deposition operation for a predetermined time, e.g. about 9 minutes for a deposition 9 mm thick, the pressure within the overflow tank 9 is returned to atmospheric pressure by turning the valve 11, and undeposited slip remaining in the mold cavity 4 is returned, by opening the valves 22, 21, to the slip tank 17 via the slip supply duct 6, flexible tube 16, valve 22, valve 21 and slip return tube 20, noting FIG. 2. Incidentally, after draining the slip, compressed air may be used to repressurize the deposited slip and lower the water content thereof uniformly, by opening the valve 11 to a compressed air source and closing the valve 22. During the drainage of the slip and the repressurization, the pressure within the gas-liquid separators 12, 12' is maintained at atmospheric pressure or negative pressure.

Then, the pressure in the gas-liquid separator 12 is made negative, compressed air is supplied into the gas-liquid separator 12' by closing the valve 13' and turning the valve 14', and the water-drainage conduit 5' is pressurized to exude some water remaining in the filter member 3' between the surface of the filter member 3' and the molded article to form a water film between them. The lower mold portion 2*b* is separated from the upper mold portion 2*a* and moved downward to remove the mold portion 2*b*, and the molded article 31 is attracted by vacuum into the filter member 3 where it hangs from the upper mold portion. The wagon 27 for the molded article is moved under the suspended article 31, and the table lifter 29 is elevated to allow the stand 30 to approach the bottom of the molded article 31. Then, compressed air is supplied into the gas-liquid separator 12 by turning the valve 14 to pressurize the water-drainage conduit 5. Thus, some water remaining in the filter member 3 is exuded between the filter member 3 and the molded article 31 to form a water film between them, and the molded article 31 is released from the upper mold portion 2*a* so that it rests on the stand 30 by gravity. The table lifter 29 is then moved downward, the wagon 27 for the molded article is moved to a waiting position shown by the two-dotted chain line in FIG. 3, and thus the hollow molded article 31 placed on the stand 30 is obtained. The lower mold portion 2*b* is elevated and mated with the upper mold portion 2*a*, and they are clamped for the next casting operation.

In the embodiment wherein the upper mold portion is removed first and then the lower mold portion is turned upside down, the operations are the same as the above described operations except that a water film is formed first between the filter member of the upper mold portion and the molded article, the upper mold portion is removed upward, whereby the molded article is attracted into the lower mold portion, and then the lower mold portion is turned upside down with the molded article hanging therefrom.

The preferred embodiments of the method for drain-casting a slip are given below. These data, however, can be readily modified by those skilled in the art on the basis of the present disclosure in compliance with the filter material, the slip characteristics and the like.

(i) Compositions of the slip to be used

A slip conventionally used for casting or drain-casting is successfully utilized in the present invention. The composition of the slip is shown as an example in the following, wherein the percentages are approximate values by weight and the solid components may contain some moisture.

clays: 17 to 38% (typically 24%)
pottery stone powder: 40 to 60% (typically 48.5%)
feldspar: 10 to 20% (typically 14%)
chamotte: 8 to 10% (typically 9%)
dolomite: 0.1 to 1.0% (typically 0.5%)
water on the basis of solid components: 35 to 50% (typically 40%)

(ii) Temperature of the slip

The temperature of the slip is generally in the range of 10° to 60° C., preferably 15° to 40° C. and typically 25° to 35° C. In practice, the slip is warmed up to about 28° C. in cold weather, and the slip is maintained at the above mentioned temperature range by agitation in mild or hot weather. Incidentally, the term "slip" used herein refers to a flowable aqueous suspension of ceramic or porcelain materials for casting or drain-casting maintained generally at a temperature given above.

(iii) Pressure applied to the slip in the deposition step

The pressure is in the range of 1 kgf/cm$^2$ to a safe pressure of the filter member, preferably about 5 to about 50 kgf/cm$^2$ and typically about 7 to about 30 kgf/cm$^2$.

(iv) Depressurization of water-drainage conduits in the deposition step

The pressure depends on the filter member and the conduit to be used. The depressurization may be zero, but is generally in the range of 10 mmHg to a safe pressure of the filter member, preferably about 200 mmHg or more, and typically about 500 mmHg or more.

Incidentally, it has been unexpectedly found by the present inventors that, in the course of deposition of a slip onto the filter members, the deposition velocity is not in proportion to the sum of the pressure applied to the slip and the pressure evacuated through the conduits. More specifically, in the first course of the deposition, the depressurization of the conduits does not make a large difference when the filter member is rather dry, but in the later course of the deposition, the deposition velocity and the hardness of molded articles are markedly increased by depressurizing the water-drainage conduits. Moreover, the depressurization of the conduits in the first course of the deposition may sometimes cause clogging of the filter members. It may be said that it is effective to conduct the depressurization of the conduits only in the later about $\frac{2}{3}$ to 1/20 and preferably in the later about $\frac{1}{2}$ to 1/10 course of the deposition step. Anyway, it is preferred that the depressurization of the water-drainage means be employed during, i.e. at least in some course of, the slip-deposition step of the present invention.

(v) Thickness of the deposited slip

The suitable thickness is generally in the range of about 3 mm to about 25 mm in the case of hollow molded articles and actually will be about 10 mm. The deposition amount and the molding time are substantially porportionate in this thickness range. (vi) Surface hardness of molded articles upon removing the mold The hardness number is measured by a rubber-stamping hardness tester supplied by Peacock Company. In accordance with the present invention, a molded article having the following hardness can be demolded and placed on a stand without deformation or damage thereof;

Outer surface of molded articles 60 to 80, preferably 70 to 80,

Inner surface of molded articles 30 to 40.

(vii) Pressure applied to the conduit to exude water upon removing the mold

The pressure depends on the filter member, and is generally in the range of 0.5 to 9 kgf/cm$^2$, preferably 1 to 7 kgf/cm$^2$ and typically 2 to 5 kgf/cm$^2$.

(viii) Evacuation of the conduit to attract the molded article into the filter member of a mold portion The depressurization is generally 10 mmHg or more, preferably 200 mmHg or more and typically 500 mmHg or more.

EXAMPLE AND COMPARATIVE EXAMPLES

An apparatus as described above and illustrated in FIGS. 1 through 3 was used to carry out drain-casting operations to obtain hollow molded articles. The water-drainage conduits used were as shown in FIG. 4. The specifications of the apparatus used and conditions of the casting and demolding operations employed were as follows:

(a) Effective thickness of the filter member: about 70 mm.
(b) Porosity of the filter material: about 42%.
(c) Pore size of the filter material: about 3 microns.
(d) Permeability variation: about 10%
(e) Interval between water-drainage conduits: about 30 mm.
(f) Material and outer diameter of the conduit: knitted cotton tube, about 10 mm.
(g) Filter material: gypsum
(i) Composition of the slip used: composed of the aforedescribed typical composition.
(ii) Temperature of the slip: about 29° C.
(iii) Pressure applied to the slip in the deposition step: about 10 kgf/cm$^2$.
(iv) Depressurization of water-drainage conduits in the deposition step: about 500 mmHg in the later $\frac{1}{2}$ course thereof.
(v) Thickness of the deposited slip: about 9 mm.
(vi) Rubber-stamping Hardness of molded articles upon removing the mold:
Outer surface of the molded article: about 70,
Inner surface of the molded article: about 35.
(vii) Dimensions of the molded articles: Molded article for water tank about 200 mm × about 360 mm × about 390 mm(height).

Figure 2:
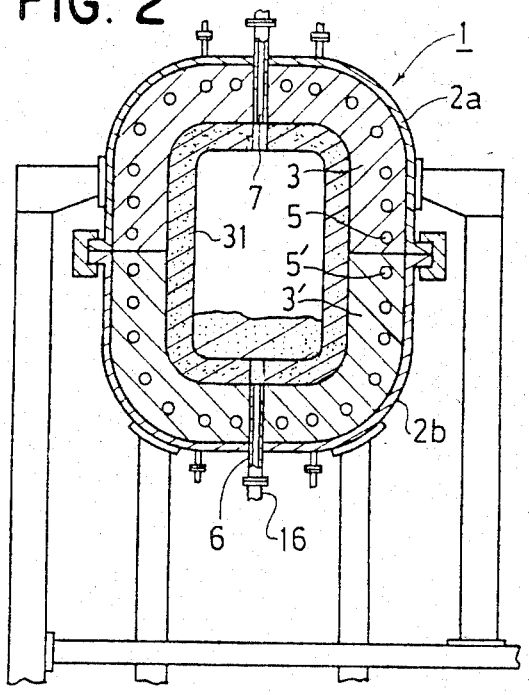
FIGS. 2 and 3 are partially sectional schematic elevational views showing an embodiment of the method for drain-casting and demolding in accordance with the present invention, respectively.
Figure 3:
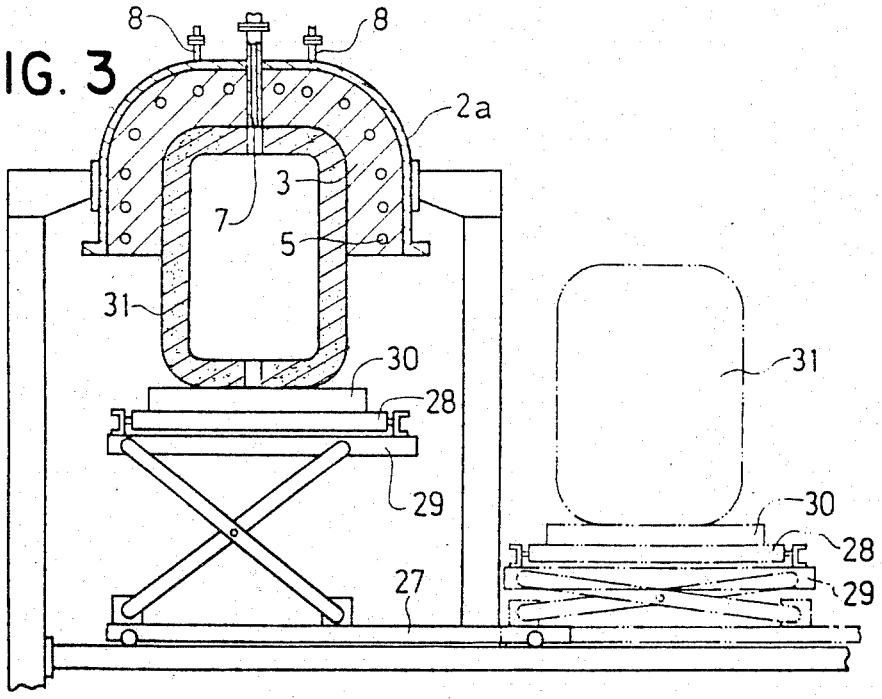

The molded articles for a water tank similar to those illustrated in FIGS. 1 through 3 were produced in accordance with the present invention. The deposition step commencing the supply of the slip and ending the drainage of the slip took about 12 minutes. The subsequent step for demolding the molded article on a stand safely without deformation or damage thereof took about 2 minutes.

For comparisons, the following experiments, the conditions of which were outside of those of the present invention were also conducted as described below:

(A) In the case where the water-drainage conduit was not depressurized to attract and hang the molded article, the step of demolding the molded article had to be conducted by troublesome hand operations after standing the molded article in the mold for a long period of time. The molded article was broken when demolded after standing it for 1 hour. The article could be demolded by hand operations after standing it in the mold for 1.5 hours.

(B) In the case where compressed air was not applied to the water-drainage conduit to exude water between the molded article and the filter member, it was necessary to dry and shrink the volume of the molded article in order to demold the article. Thus, it took about 2 hours to dry the article in the mold and demold the article.

As described above in detail, the method for drain-casting a slip by the use of the apparatus therefor in accordance with the present invention comprises the step of pressurizing the slip within the mold and draining water through the water-drainage means formed within the mold, the step of exuding some water between the molded article and a mold portion to remove that mold portion and attracting the molded article onto the other mold portion to hang the article thereby, and the step of exuding some water between the molded article and the filter member of the second mold portion to place the molded article on a stand by gravity. Thus, the following excellent effects, among others, are realized:

(i) the cast-molded article in conformity with predetermined specifications having no deformation and damage is rapidly obtained on the stand, since no local stress is applied to the molded article during the steps;

(ii) due to the synergistic effect of pressurization of the slip and the positive water drainage through the conduits formed within the filter members, the time for deposition of the slip is markedly shortened, whereby the total operation time including casting and demolding for obtaining one molded article is as short as about 15 minutes or so;

(iii) the cast molding is carried out successively without drying the filter members, whereby the production capacity is increased about 48 times as compared with two articles per day in the conventional hand-operated drain-casting operations;

(iv) moreover, the casting mold for the apparatus of the present invention is durable for about 800 to 1000 molding operations;

(v) as a result, productivity is largely enhanced and also the cost for molded articles is markedly lowered.

What is claimed is:

1. A method for drain-casting a slip to obtain a substantially hollow molded article, by the use of an apparatus comprising a mold including at least two divisible mating mold portions to form a mold cavity, each mold portion including a pressure-proof air-tight vessel and a filter member inside the vessel, said filter member containing a water-drainage means, said water-drainage means being communicated with the openings outside of the vessel, one of said mold portions having an overflow duct communicated with the outside of the vessel, and one other mold portion having a slip supply duct; which method comprises the steps of:

supplying slip through the slip supply duct to the mold cavity until the supplied slip overflows the overflow duct;

closing the slip supply duct and pressurizing the slip within said mold cavity via the overflow duct to facilitate deposition of the slip onto the filter members of the mold to a desired thickness, water being drained from the mold via said water drainage means;

adjusting the position of the slip supply duct downward and draining the undeposited slip remaining in the mold cavity through the slip supply duct;

depressurizing the water-drainage means of one mold portion to create a vacuum between said one mold portion and the resulting article thereby attracting the resulting article into said one mold portion, applying compressed air to the water-drainage means of the other mold portion to exude some water between the filter member and the resulting molded article, and removing said other mold portion from the molded article; and then hanging the molded article attracted into said one mold portion over a stand, applying compressed air to the water-drainage means of the mold portion to exude some water between the filter member of said one mold portion and the molded article, and demolding the molded article onto the stand.

2. The method according to claim 1, in which during the pressurization of the slip the water-drainage means are depressurized.

3. The method according to claim 2, in which the depressurization of the water-drainage means is conducted in the later about $\frac{2}{3}$ to about 1/20 course of the deposition step.

4. The method according to claim 1, further comprising the step of selecting the water-drainage means to comprise a water-drainage conduit.

5. The method of claim 2, in which the water-drainage means is a water-drainage conduit.

6. The method according to claim 1, further comprising the step of selecting the slip to comprise a flowable aqueous suspension of a ceramic or porcelain material.

7. The method according to claim 1, in which after draining the slip compressed air is supplied via the overflow duct to pressurize the deposited slip and lower the water content of the molded article.

8. The method according to claim 1, in which the mold portions are set in upper and lower positions to be mated together.

9. The method according to claim 8, in which the upper mold portion is removed first, the lower mold portion is turned upside down to hang the molded article, and the article is demolded onto a stand.

10. The method according to claim 9, in which a molded article having a substantially protuberant part is produced by providing the mold to contain the protuberant part in the lower mold portion having a slip supply duct.

11. The method according to claim 4, further comprising the step of selecting the water-drainage conduit contained in the filter member to comprise a plurality of circuits, each of the circuits being independently communicated with the openings outside of the pressure-proof vessel.

12. The method according to claim 1, in which the water-drainage means contained in the filter member is selected to comprise a plurality of circuits, each of the circuits being independently communicated with the openings outside of the pressure-proof vessel.

13. The method according to claim 1, in which the water-drainage means of one mold portion is depressurized, the water-drainage means of the other mold portion is pressurized, and said other mold portion is moved to remove said other mold portion from the molded article.

14. The method according to claim 1, in which the slip within said mold cavity is constantly pressurized throughout the deposition step.

15. A method according to claim 1, in which the slip within said mold cavity is pressurized at a pressure of about 1 kgf/sq.cm or more.

16. The method according to claim 15, in which the slip within said mold cavity is pressurized at a pressure of about 5 kgf/sq.cm or more.

17. The method according to claim 1, in which the slip within said mold cavity is pressurized by supplying compressed fluid to the overflow duct.

* * * * *